United States Patent [19]

Hartel et al.

[11] Patent Number: 4,733,425

[45] Date of Patent: Mar. 29, 1988

[54] MASCARA BRUSH

[75] Inventors: Franklin J. Hartel; Eric W. Sanderson, both of Palmer, Mass.

[73] Assignee: Sanderson-MacLeod, Inc., Palmer, Mass.

[21] Appl. No.: 874,842

[22] Filed: Jun. 16, 1986

[51] Int. Cl.[4] ..... A46B 3/16; A46B 9/00; A46B 15/00

[52] U.S. Cl. ..... 15/206; 15/159 A; 401/118; 401/129; 132/88.7

[58] Field of Search ..... 15/159, 206, 207; 132/88.7, 85, DIG. 3; 401/129, 118; D4/131, 132, 134; D28/7

[56] References Cited

U.S. PATENT DOCUMENTS

| | | | |
|---|---|---|---|
| 748,917 | 1/1904 | Braun | 15/206 |
| 1,337,819 | 4/1920 | Braun | 15/206 |
| 2,015,030 | 9/1935 | Collier | 15/206 |
| 2,433,325 | 12/1947 | Slaughter | 15/159 A |
| 2,627,621 | 2/1953 | Bardugon | 15/206 |
| 2,637,893 | 5/1953 | Shaw | 15/159 A |
| 3,121,040 | 2/1964 | Shaw et al. | 15/159 A |
| 3,344,457 | 10/1967 | Grobert | 15/159 A |
| 3,582,140 | 6/1971 | Kaufman et al. | 15/206 X |
| 4,307,478 | 12/1981 | Ward et al. | 15/159 A |
| 4,403,624 | 9/1983 | Montgomery | 132/88.7 |
| 4,559,268 | 12/1985 | Nakashima et al. | 15/159 A X |

FOREIGN PATENT DOCUMENTS

| | | | |
|---|---|---|---|
| 26407 | of 1904 | United Kingdom | 15/159 A |
| 544870 | 4/1942 | United Kingdom | 15/206 |

*Primary Examiner*—Richard J. Apley
*Assistant Examiner*—Franklin Gubernick
*Attorney, Agent, or Firm*—Chapin, Neal & Dempsey

[57] ABSTRACT

Mascara brush construction composed of a plurality of radially extending bristle filaments fastened in brush formation by a helically twisted metallic wire core. The bristles are tubular or hollow polyamide filaments, each crimped at the midpoint of its length by portions of the helically twisted wire so that the filament halves flare outward in various directions from the brush core. In an alternate embodiment the filaments are noncircular in cross-section and include a plurality of longitudinal, radially extending flange portions.

5 Claims, 6 Drawing Figures

MASCARA BRUSH

BACKGROUND OF THE INVENTION

This invention relates to improved mascara brushes in which the bristle filaments are secured together in brush form by a helically twisted metallic wire core.

A spiral mascara brush of conventional construction comprises a multiplicity of bristles usually consisting of Nylon filaments gripped in a continuous spiral array, such that the free ends of the bristles generally follow a helical pattern much the same as the helix of the twisted wire core itself. Typically, the core of the brush consists of a unitary metallic wire reversibly folded in a generally U-shaped configuration. Filaments of approximately twice the length of final bristle heights are disposed between the legs of the U-shaped wire. The limbs of the wire are then twisted to form a helical core which holds the filaments at their midpoints so as to clamp them in a helical or spiral configuration. The filaments which usually form the bristles of such a brush are generally cylindrical in shape. The twisted wire is usually provided with a handle at its outer end which may also serve as the cap or closure for the mascara container. Brushes of this type are well known in the art and have been widely used up to the present time.

The general purpose of a mascara brush is to pickup a supply of mascara or some other cosmetic medium, carry it from the container and then apply the mascara to the user's eyelashes. For this purpose, it is important to have a brush in which its bristle tips are uniformly distributed throughout the bristle face of the brush. It is also important that the bristles be capable of readily picking up an ample supply of mascara at one time and effectively carrying or holding the same until the mascara is transferred to the eyelashes. It is also important that the bristles have sufficient flexural strength to comb the mascara through the eyelashes of the user.

It has been known in the paintbrush art, to use bristles of tapered cruciform and other cross-sectional configurations. U.S. Pat. No. 3,344,457 discloses a number of such paintbrush filaments. But these filaments are merely incorporated into the brush by gluing them into the ferrule of the paintbrush in parallel relationship.

U.S. Pat. No. 4,561,456 discloses an injection molded mascara brush in which the bristles have hooked or enlarged tip portions to increase the cosmetic product retained by so-called capillarity. Of course, brushes of this type would require expensive and complicated tooling to effect such molding results.

In accordance with this invention, the bristle material used is a hollow or tubular polyamide or one which has a noncircular cross-section which extend radially from a twisted wire core. The hollow or noncircular bristles may either be used alone or in combination with other bristles of regular cylindrical cross-section.

The principal object of this invention is to provide an improved mascara brush which may be fabricated by a conventional twisted wire technique but which provides for more uniform radial distribution of the brush tips a the bristle face than was heretofore available.

It is another object of this invention to provide an improved mascara brush which has enhanced capability of media pickup and retention for more effective cosmetic application to the eyelashes of the user.

The above and other objects and advantages of this invention will be more readily apparent from a reading of the following description taken together in conjunction with the accompying drawing in which.

Figure 2:
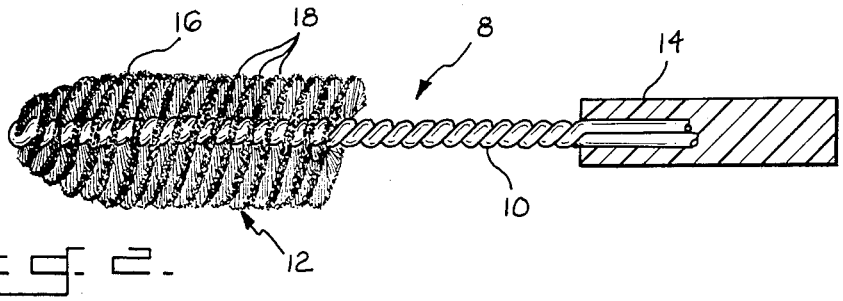
Fig. 2. (PRIOR ART)
FIG. 2 is an elevational view, partly in crosssection, illustrative of a prior art brush of the same general type as those embodying this invention.

In FIG. 2 is shown a cosmetic applicator or mascara brush 8 of the conventional type. The brush comprises a twisted metallic wire core 10 and a plurality of radially extending bristles 16 which make up the bristle portion 12 of the brush. The tips of the bristles define a generally cylindrical bristle face with a conically tapered end portion. The brush also includes a cylindrical handle 14 disposed on the outer end portion of the twisted wire core.

Figure 1:
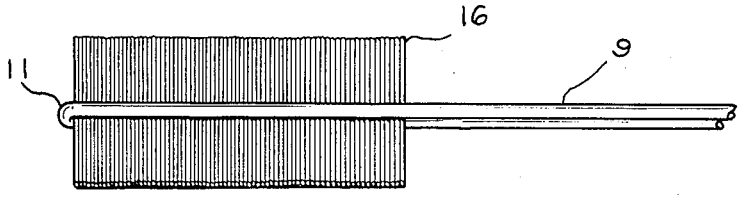
FIG. 1 is an elevational view of one step in the process of manufacturing brushes of the type embodying this invention.

Brushes of this type are fabricated by using a pliable metallic wire 9, reversibly folded back upon itself as depicted at 11 in FIG. 1. Of course, it would also be feasible to use two separate wires twisted together in the same manner. A plurality of cylindrical filaments 16, each having a length equal to the diameter of the bristle portion of the brush 8, are placed between the two legs or limbs of the core forming wire 9. The wire limbs are then twisted together to form a helix which grips the filaments at the midpoint of their length causing the filaments 16 to be folded in half. Because of their regular cross-section, the filaments are gripped so as to follow the helical pattern of the twisted wire core. This means that at the face of the bristle portion 12 of the brush 8, the bristle tips define helical loops or rings 18 having a substantial axial space, gap or void between each loop where there are no bristle tips. Such helically patterned brushes have a tendency of nonuniform media pickup and uneven application.

Figure 3:
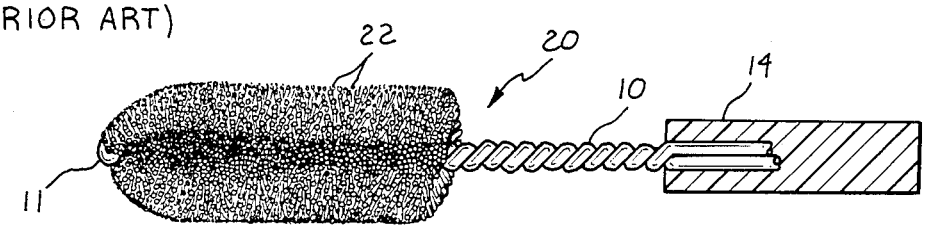
FIG. 3 is a view similar to FIG. 2 of one type of brush embodying this invention.
Figure 5:
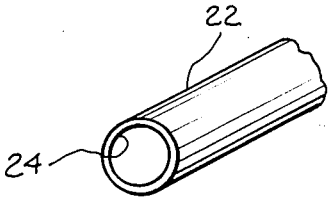
FIG. 5 is a perspective view on a greatly enlarged scale showing a portion of a filament of the type used in the brush of FIG. 3.

In contrast with the prior art, brushes made in accordance with this invention, as shown at 20 in FIG. 3, are characterized by a uniform fibre or bristle distribution despite the fact that the bristle portion of the brush is still formed by using a twisted wire core 10. In the preferred embodiment of the invention, the brush comprises the twisted, pliable, metallic core wire 10 and a plurality of hollow or tubular filaments 22. Because of their hollow construction, as shown at 24 in FIG. 5, the filaments, when gripped between the opposing limbs of the helically twisted wire, are crimped, pinched or substantially compressed or collapsed at their midpoints. When this occurs, the two halves of each filament are caused to flare outwardly in a generally V-shaped pattern. Significantly, this flaring action is more or less random in the radial direction and results in uniform bristle tip distribution at the bristle face of the brush and not the helical pattern of bristles which characterize the prior art brushes of this type, as illustrated in FIG. 2.

The filaments 22 being hollow in cross-section have relatively high longitudinal strength to weight ratio and exhibit significant capillary attraction for the liquid mascara. The hollow filaments are thus adapted to adsorb a greater quantity of the mascara for each application. Moreover, because of this capillary action, the bristles are capable of holding and carrying the supply of mascara liquid until it is transferred to the lashes of the user by the combing action of the brush bristles.

While various types of synthetic materials may be used in carrying out this invention including polyamide, polyesters, polyolefins and the like, it has been found that 6–12 type Nylon having an outer diameter of 3–8 mils performs in a highly effective manner.

As an alternative to the tubular filament, it is also within the purview of this invention to utilize filaments which are not hollow but are noncircular in crosssection and include a plurality of longitudinal, radially extending flange or rib portion 28. A typical filament of this type is shown at 26 in FIG. 6. It has been found that such cruciform filaments have characteristics of improved media pickup and retention as compared to the solid cylindrical filaments of the prior art. Unlike the hollow filaments 22, however, filaments 26 do not have the added feature of capillarity. It has been found that non-circular filaments having an outer diameter of 2.5–8 mils are also most satisfactory for use in mascara brushes embodying this invention.

Figure 4:
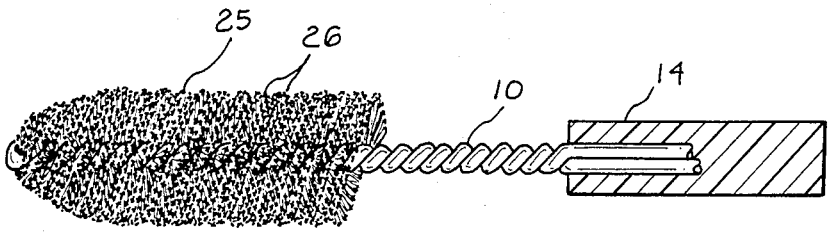
FIG. 4 is a view similar to FIG. 3 showing an alternative type of brush embodying this invention.
Figure 6:
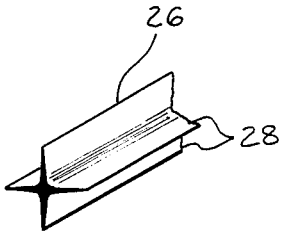
FIG. 6 is a view similar to FIG. 5 of a filament of another type as used in the brush of FIG. 4.

It has also been found that in a manner similar to the tubular filaments 22, the noncircular filaments, such as shown at 26 in FIG. 6, when clamped by the twisted wire core, are also crimped so that the two halves are caused to flare outwardly of the wire core in randomly diverging radial relation. As a result, the tip portions of the filaments are uniformly distributed at the bristle face, both axially and circumferentially, as shown generally at 25 in FIG. 4.

With either of the disclosed embodiments, the brush bristles are adapted to pickup more mascara in each application than a conventional brush and transport it to the eyelashes of the user with minimum tendency for the mascara to drip from the brush. In addition, the uniform bristle orientation of the mascara brush embodying this invention, provides for more even application of the mascara to the eyelashes of the user.

Thus, this invention provides a simple and yet highly effective brush construction for picking up, transporting and applying mascara. Moreover, the brush construction utilizes a twisted wire core construction of the type which has been widely used with Nylon type filament of solid cylindrical cross-section.

Having thus disclosed my invention, what is claimed is:

1. Applicator brush for liquid-type cosmetics comprising a core and bristle portion having a bristle face of generally circular configuration, said core being formed by lengths of metallic wire helically twisted together, said bristle portion being formed by a plurality of bristles extending radially from said core, pairs of said bristles being formed by discrete synthetic plastic filaments that are tubular or have irregularly shaped cross-sections and which are gripped medially of their outer ends by the twisted lengths of wire, the cross-sectional configuration and stiffness of said filaments being such that the gripping thereof will cause said filaments to be crimped so that the filaments flare outwardly in various directions from said core whereby the tip portions of said bristles are generally uniformly distributed throughout said bristle face.

2. Applicator brush as set forth in claim 1, in which at least some of said filaments, except where crimped by the wire core, are tubular in cross-section throughout their length

3. Applicator brush as set forth in claim 1, in which at least some of said filaments, except where crimped by the wire core, are generally cylindrical and hollow in cross-section and are polyamide material.

4. Applicator brush as set forth in claim 1, in which at least some of said filaments are noncircular in cross-section and include a plurality of radially extending web portions.

5. Applicator brush as set forth in claim 4, in which some of said filaments include longitudinal, radially extending flange portions.

* * * * *